United States Patent [19]

Saiki et al.

[11] Patent Number: 4,972,948

[45] Date of Patent: Nov. 27, 1990

[54] MULTI-MODULE GOLF BALL SLEEVE

[76] Inventors: Shinzo Saiki, 10 Crystal Dr., Great Neck, N.Y. 11021; Kuniaki Nomura, 61 Jones St., New York, N.Y. 10014

[21] Appl. No.: 524,844

[22] Filed: May 18, 1990

[51] Int. Cl.[5] ..... B65D 3/04; B65D 3/26; B65D 85/58

[52] U.S. Cl. ..... 206/315.900; 206/602; 206/627; 229/87.05

[58] Field of Search ..... 206/0.8, 315.9, 445, 206/602, 627; 229/87.05, 87.2, 87.5, 93

[56] References Cited

U.S. PATENT DOCUMENTS

| | | | |
|---|---|---|---|
| 3,047,140 | 7/1962 | Robins | 206/315.9 |
| 3,386,643 | 6/1968 | Gentry | 206/627 |
| 3,815,735 | 6/1974 | Cucuo | 206/315.9 |
| 4,491,221 | 1/1985 | Lange | 206/315.9 |
| 4,564,107 | 1/1986 | Heitzenroder et al. | 206/315.9 |

*Primary Examiner*—Jimmy G. Foster

*Attorney, Agent, or Firm*—Michael Ebert

[57] ABSTRACT

A sleeve for packaging a set of golf balls to create separable modules, each housing an individual ball. The sleeve is formed from a single rectangular cardboard blank divided into equal sections by transverse lines of perforations extending between opposing edges of the blank and passing through the diameters of upper and lower circles scored in the blank, the diameters being slit. Scored in opposing ends of the blank are upper and lower semicircles whose diameters are a respective end. The golf balls in the set are placed at the centers of the sections and the blank is wrapped thereabout and edge-sealed to define a cylindrical sleeve. The semicircular regions defined by the slit circles and the semicircles on the blank are pressed in to create modules in each of which a ball is trapped. Each module is separable from the sleeve at the perforated line. When so separated, the module is open-ended and the ball may be extracted therefrom by pushing it out of the module with a finger.

5 Claims, 2 Drawing Sheets

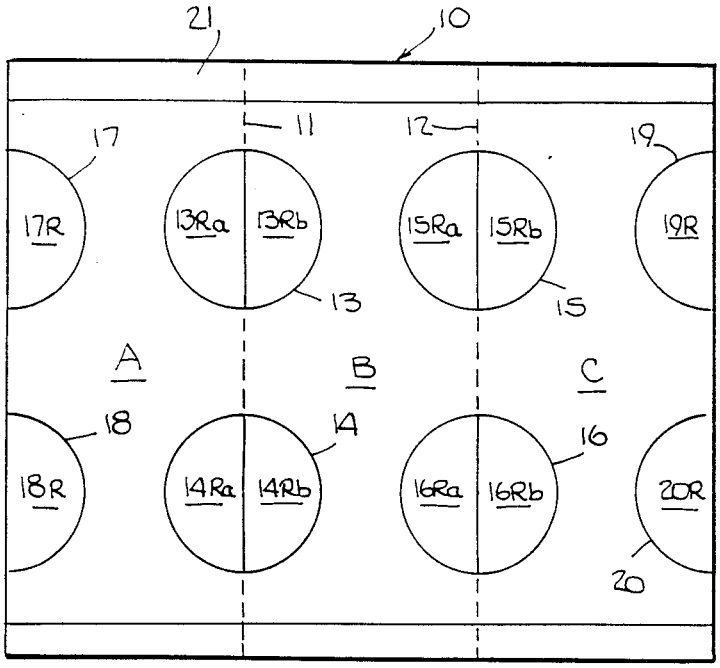
Fig. 1.
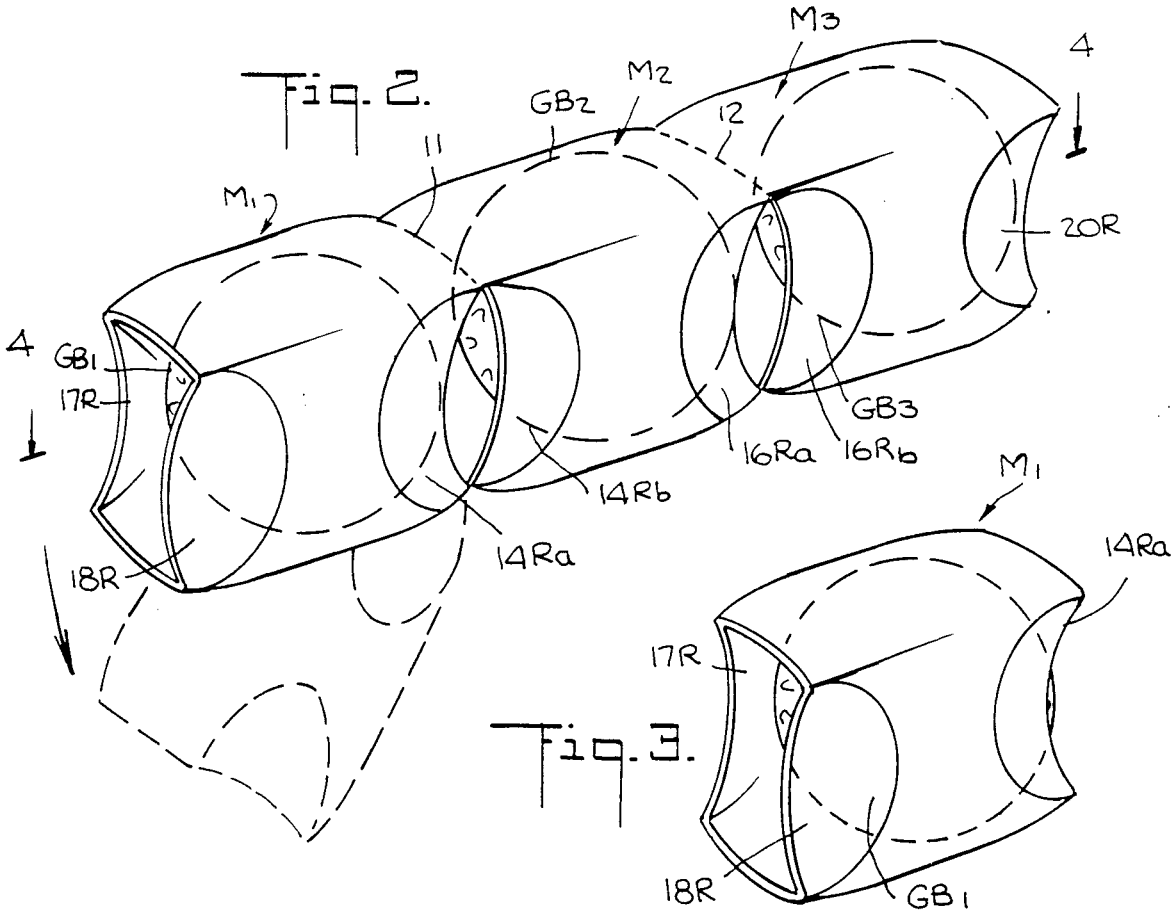
Fig. 2.
Fig. 3.

MULTI-MODULE GOLF BALL SLEEVE

BACKGROUND OF INVENTION

1. Field of Invention

This invention relates generally to the packaging of golf balls, and more particularly to a multi-module golf balls sleeve for packaging a set of golf balls to create separable modules each housing an individual ball which may be pushed out of the module.

2. Status of Prior Art

The game of golf involves hitting a small hard ball whose outer white spherical casing has an array of dimples formed therein. The ball is hit with specially made clubs or irons over an outdoor course, called links. The full complement of clubs is normally stored in a golf bag carried by the player or his caddy, the bag being provided with a pocket to store a supply of golf balls.

Golf balls are usually packed in a box containing a set of three or more balls. Each time a player wishes to obtain a ball, he must open the box to remove a ball therefrom and then close the box. And if the player wishes to load his golf bag with golf balls, he must first remove the balls from the box and insert them in the pocket of the bag.

If the golf bag is heavily used, its golf ball pocket may become dirty, and the balls stored therein may become soiled. Also, when the balls are so stored, they are not adequately protected, and their surfaces may become abraded or scratched.

A golf player who is serious about his game requires golf balls in pristine condition. He also requires a quick access to the balls. These requirements are not met by existing golf ball boxes or packages.

SUMMARY OF INVENTION

In view of the foregoing, the main object of this invention is to provide a multi-module golf ball sleeve for packaging a set of golf balls in which each module entraps a single ball and is readily separable from the sleeve to form an open-ended module from which the ball may be extracted simply by pushing it out of the module.

More particularly, the object of this invention is to provide a multi-module sleeve formed from a single blank of cardboard material.

A significant advantage of the invention is that each ball in the sleeve is separated from the other balls in the set and is maintained in pristine condition.

Also an object of the invention is to provide a multi-module golf ball sleeve which may be mass-produced at relativelty low cost.

Briefly stated, these objects are attained in a sleeve for packaging a set of golf balls to create separable modules, each housing an individual ball. The sleeve if formed from a single rectangular cardboard blank divided into equal sections by transverse lines of perforation extending between opposing edges of the blank and passing through the diameters of upper and lower circles scored in the blank, the diameters being slit.

Scored in opposing ends of the blank are upper and lower semicircles whose diameters are a respective end. The golf balls in the set are placed at the centers of the sections and the blank is wrapped thereabout and edge-sealed to define a cylindrical sleeve. The semicircular regions defined by the slit circles and the semicircles of the blank are pressed in to create modules in each of which a ball is trapped. Each module is separable from the sleeve at the perforated line. When so separated, the module is open-ended and the ball may be extracted therefrom by pushing it out of the module with a finger.

BRIEF DESCRIPTION OF DRAWINGS

For a better understanding of the invention as well as other objects and further features thereof, reference is made to the following detailed description to be read in conjunction with the accompanying drawings, wherein:

FIG. 1 shows, a plan view, a single blank from which is formed a multi-module golf ball sleeve in accordance with the invention;

FIG. 2 is a perspective view of a sleeve having three modules for packaging a set of three golf balls;

FIG. 3 is a perspective view of a single open-ended module after it has been separated from the sleeve;

FIG. is a perspective view of the open-ended module illustrating the manner in which the golf ball is pushed out of the module.

DESCRIPTION OF INVENTION

Figure 4:
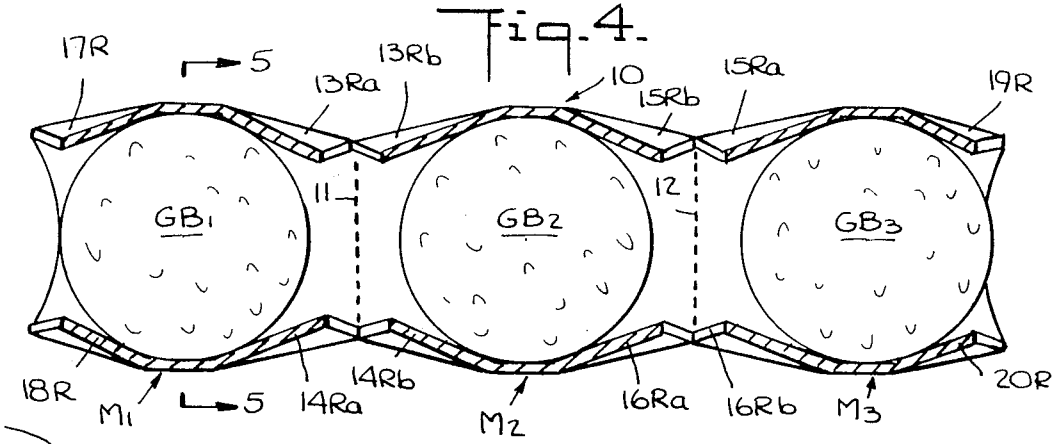
FIG. 4 is a longitudinal section taken in the plane indicated by line 4—4 in FIG. 2.

Referring now to FIG. 1, there is shown a rectangular blank 10 formed of cardboard or similar flexible sheeting adapted to create a sleeve for packaging a set of three golf balls. It is to be understood that the invention is not limited to a set of three balls and that the sleeve may be fabricated to house a larger number of balls.

Blank 10 is divided into three equal sections A, B and C by transverse lines 11 and 12 of perforations extending between the longitudinal edges of the blank. Line 11 passes through the diameters of upper and lower circles 13 and 14 scored in the blank. The diameters of circles 13 and 14 are slit to divide the circles into semicircular intermediate regions $13R_a$-$13R_b$ and $14R_a$-$14R_b$. Line 12 passes through the diameters of upper and lower circles 15 and 16 scored in the blank. The diameter of these circles are slit to divide circles 15 and 16 into semicircular intermediate regions $15R_a$-$15R_b$ and $16R_1$-$16R_b$.

Scored at one end of the blank are upper and lower semicircles 17 and 18 whose diameters run along this end to define semicircular end regions 17R and 18R. And scored the opposing end of the blank are upper and lower semicircles 19 and 20 to define semicircular end regions 19R and 20R whose diameters run along this end. The upper semicircular regions 17R, $13R_a$, $13R_b$, $15R_a$, $15R_b$ and 19R lie on a common upper longitudinal axis, and the lower semicircular regions 18R, $14R_1$, $14R_b$, $16R_a$, $16R_b$ and 20R lie on a common lower longitudinal axis parallel to the upper axis.

To house golf ball $GB_1$, $GB_2$, $GB_3$, these balls are placed in the centers of sections A, B and C of the blank, and the blank, as shown in FIG. 2, is wraped about the balls to conform to their spherical surfaces. The blank is edge-sealed by a bank of adhesive applied to its upper margin 21 to form a protective cylindrical sleeve defined by three interconnected modules $M_1$, $M_2$, and $M_3$, each housing an individual golf ball. All of the semicircular regions are pressed in, as shown in FIG. 4, to lie adjacent the surface of the balls and thereby entrap each ball within its module.

Figure 6:
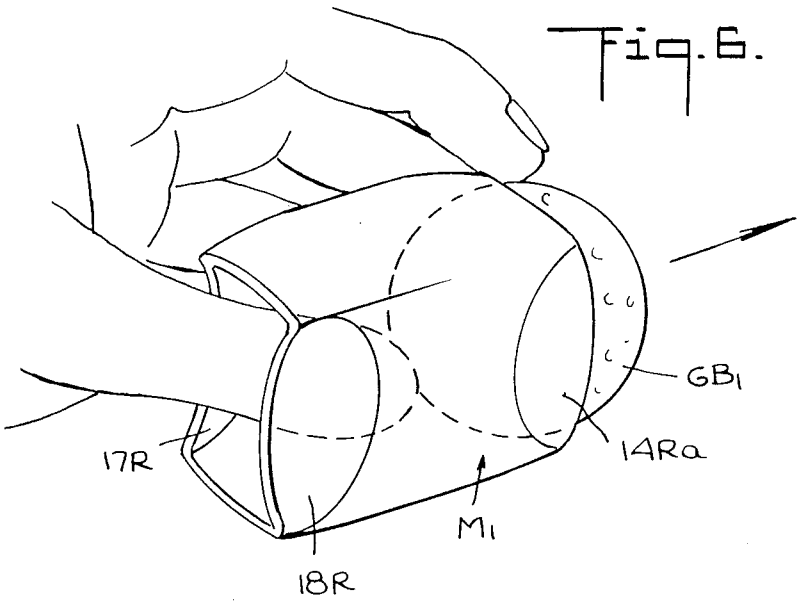
Figure 5:
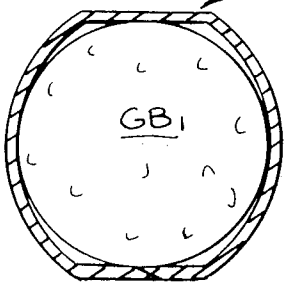
FIG. 5 is a transverse section taken through the sleeve in the plane indicated by line 5—5 in FIG. 4.
Figure 7:
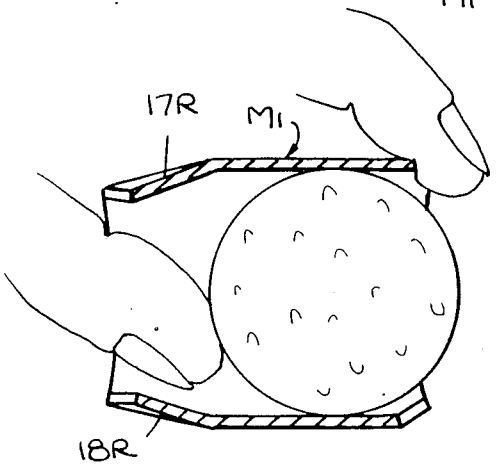
FIG. 7 is a longitudinal section taken through FIG. 6.

Because the junction in lines 11 and 12 of the sleeve are perforated, module $M_1$ may be broken off the sleeve to define, as shown in FIG. 3, an open-ended module having a ball $GB_1$ entrapped therein. To remove ball $GB_1$ from separated module $M_1$, one has only, as shown in FIGS. 6 and 7, to hold the module with the fingers of one hand 22 and to insert the thumb into one end of the module to push ball $GB_1$ out of the module through the other end. The depressed semicircular regions at this end are pressed out to release the ball from the module.

And to remove balls $GB_2$ and $GB_3$, module $M_2$ is separated from module $M_3$, so that now these balls can be pushed out of these modules.

As long as the golf balls are entrapped in the interconnected modules of the sleeve, they are separated from each other and are fully protected, and are thereby maintained in pristine condition. And in storing balls in the pocket of a golf bag, the balls need not be removed from their modules, but can be kept therein to protect the balls within the golf bag pocket.

While there has been shown and described a preferred embodiment of a multi-module golf ball sleeve in accordance with the invention, it wil be appreciated that many changes and modifications may be made therein without, however, departing from the essential spirit thereof.

We claim:

1. A multi-module sleeve for protectively packaging a set of golf balls, the sleeve being formed from a single rectangular blank of flexible sheeting divided into equal sections by transverse lines of perforations extending between the longitudinal edges of the blank, each line passing through the diameters of upper and lower circles scored in the blank, the diameters being slit to define semicircular intermediate regions, upper and lower semicircles being scored at the ends of the blank to define semicircular end regions whose diameters run along these ends, the balls to be packaged being placed at the centers of the respective sections and the blank being wrapped thereabout and being edge-sealed to create a cylindrical sleeve having interconnected modules, the semicircular intermediate and end regions being pressed in to entrap each ball within a respective module, whereby when a module is broken off the sleeve along one of said perforated lines, it is then open-ended, and the ball entrapped therein may be pushed out of the module by a finger.

2. A sleeve as set forth in claim 1, wherein said blank is formed of cardboard.

3. A sleeve as set forth in claim 1 formed by three interconnected modules, each housing a golf ball.

4. A sleeve as set forth in claim 1, wherein the upper intermediate and end regions lie on a common upper longitudinal axis and the lower intermediate and end regions lie on a common lower longitudinal axis parallel to the upper axis.

5. A sleeve as set forth in claim 1, in which each ball housed therein has a spherical outer casing provided with an array of dimples, the ball being maintained in pristine condition within its module, the diameter of the sleeve being substantially the same as that of the ball.

* * * * *